US010098487B2

(12) United States Patent
Willat et al.

(10) Patent No.: US 10,098,487 B2
(45) Date of Patent: Oct. 16, 2018

(54) WINE GLASS

(75) Inventors: Boyd I. Willat, Venice, CA (US); Joseph T. Perrulli, St. Helena, CA (US); Amber R. Willat, Venice, CA (US); Paul H. Velick, Santa Monica, CA (US); Gary D. Delgado, New York, NY (US)

(73) Assignee: govino, LLC, Newport Beach, CA (US)

( * ) Notice: Subject to any disclaimer, the term of this patent is extended or adjusted under 35 U.S.C. 154(b) by 349 days.

(21) Appl. No.: 13/027,013

(22) Filed: Feb. 14, 2011

(65) Prior Publication Data

US 2011/0132910 A1 Jun. 9, 2011

Related U.S. Application Data

(60) Division of application No. 11/932,179, filed on Oct. 31, 2007, now Pat. No. 7,886,924, which is a (Continued)

(51) Int. Cl.

| | |
|---|---|
| ***A47J 43/27*** | (2006.01) |
| ***A47G 19/23*** | (2006.01) |
| ***A47G 19/22*** | (2006.01) |
| ***B65D 8/00*** | (2006.01) |
| ***B65D 75/58*** | (2006.01) |
| ***B65D 77/06*** | (2006.01) |
| ***B65D 21/02*** | (2006.01) |

(52) U.S. Cl.

CPC ..... *A47G 19/23* (2013.01); *A47G 19/2205* (2013.01); *A47G 19/2227* (2013.01); *A47G 19/2255* (2013.01); *B65D 11/02* (2013.01); *B65D 21/0233* (2013.01); *B65D 75/5866* (2013.01); *B65D 77/06* (2013.01); *A47G 2400/045* (2013.01)

(58) Field of Classification Search

CPC ..... B65D 23/102; B65D 1/0223; B65D 2501/0036; B65D 2501/0081; B65D 79/005

USPC ..... 215/384, 379, 382, 383, 397, 373; 239/45; 206/217, 219, 222, 430, 509; 220/694, 675, 703; D9/516, 540, 543

See application file for complete search history.

(56) References Cited

U.S. PATENT DOCUMENTS 2,142,811 A * 1/1939 Agonis ..... A47G 19/2205 215/384

4,628,705 A * 12/1986 Nave ..... F25D 3/08 62/371

(Continued)

*Primary Examiner* — Fenn C Mathew
*Assistant Examiner* — Cynthia Collado
(74) *Attorney, Agent, or Firm* — Lowry Blixseth LLP; Scott M. Lowry

(57) ABSTRACT

A wine glass constructed from molded plastic includes an upper body defining an upwardly narrowed flume for concentrating the wine bouquet, in combination with a contoured lower base defining an annular moat surrounding a central punt for enhanced visual inspection of the wine. In addition, the upper body further includes a notched indent at an outboard side thereof forming a shelf for facilitated fingertip grasping and manipulation of the assembled glass. In one form, the upper body and lower base of the wine glass are provided as separate modules adapted for assembly to form the wine glass, and disassembly for respective compact stacking. In another form, the wine glass has a one-piece construction adapted for compact stacking by nested reception of the upwardly narrowed flume partially into the underside of the lower base of an overlying glass in the stack.

17 Claims, 7 Drawing Sheets

Related U.S. Application Data continuation-in-part of application No. 11/668,046, filed on Jan. 29, 2007, which is a continuation-in-part of application No. 11/309,159, filed on Jul. 3, 2006, now Pat. No. 8,567,635, which is a continuation-in-part of application No. 10/979,847, filed on Nov. 1, 2004, now Pat. No. 7,273,147.

(60) Provisional application No. 60/592,809, filed on Jul. 29, 2004, provisional application No. 60/517,755, filed on Nov. 5, 2003.

(56) References Cited

U.S. PATENT DOCUMENTS

D328,014 S * 7/1992 DeCoster ..... D7/629
5,669,520 A * 9/1997 Simpson ..... A61J 9/00 215/11.1
5,927,533 A * 7/1999 Payne ..... B65D 23/102 215/375
6,059,443 A * 5/2000 Casey ..... A45F 3/16 206/219
6,296,388 B1 * 10/2001 Galomb ..... B65D 33/16 222/478
6,594,927 B2 * 7/2003 Witkowski ..... G09F 3/0288 40/306
8,152,018 B2 * 4/2012 Smith ..... B65D 1/46 220/675
2001/0022304 A1 * 9/2001 Roche ..... B65D 43/0229 220/212
2003/0116525 A1 * 6/2003 Futral ..... B65D 1/0276 215/373
2005/0211662 A1 * 9/2005 Eaton ..... B65D 1/0276 215/384
2008/0217425 A1 * 9/2008 Butler ..... A01M 1/2044 239/45

* cited by examiner

WINE GLASS

BACKGROUND OF THE INVENTION

This invention relates generally to improvements in wine glasses which may be constructed from relatively light-weight and cost efficient plastic materials. More specifically, this invention relates to an improved wine glass of modular or unitary construction, wherein the assembled wine glass is easily grasped and is shaped to facilitate inspection of the bouquet and visual characteristics of a selected wine, and further wherein a plurality of wine glasses or modular components thereof are shaped for relatively compact stacking for convenient shipping and/or storage.

Wine is commonly served at a wide variety of social gatherings and events ranging from small to large, and from informal to formal. In this regard, it is generally recognized that the olfactory, visual and taste characteristics of any given wine are best displayed and best judged by use of a traditional transparent wine glass having a rounded or bowl-shaped bottom of expanded cross sectional size relative to an upwardly and inwardly tapering upper flume. This classic wine glass shape enables close visual inspection of wine color and meniscus and other visual characteristics by swirling a small amount of the wine within the bowl-shaped bottom of the glass, while the narrowing upper flume tends to concentrate the bouquet of the wine for facilitated sensory detection and enjoyment. Traditionally, such wine glasses have been constructed from glass, typically by supporting the bowl-shaped bottom of the glass on a narrow stem which projects upwardly from a disk-shaped lower base.

Wine glasses constructed from glass, however, are fragile and thus susceptible to breakage during normal use, and in the course of shipping and handling prior to use, and further in the course of post-use handling including washing, drying and returning the glasses to storage. In addition, a set of glass-constructed wine glasses can be relatively costly, particularly when large numbers of glasses are required for use at a social event. Moreover, the shape of the traditional wine glass, including the narrowed upper flume, inherently precludes compact stacking of multiple glasses for space-efficient shipping and storage.

As a result, alternative drinking vessels or cups formed from relatively inexpensive and substantially unbreakable molded plastic are often used for serving wine, in lieu of traditional glass-constructed wine glasses. Such plastic molded cups are relatively inexpensive and thus suitable for disposal following a single use. In some configurations, such molded plastic cups have incorporated surface features designed to enhance the various visual, olfactory and taste characteristics of wine. See, for example, U.S. Pat. Nos. 6,409,374 and 6,644,846, which are incorporated by reference herein. However, such molded plastic cups are commonly formed with an upwardly expanding cross sectional shape so that the cups can be shipped and stored in a compact stacked array, but this upwardly expanding shape does not concentrate the wine bouquet. Accordingly, plastic molded cups have generally been incompatible with optimally displaying to best advantage the full range of characteristics attributable to a particular vintage, and do not optimize the presentation and enjoyment of the wine.

There exists, therefore, a need for further improvements in and to wine glasses of the type constructed from molded plastic, wherein the wine glass is shaped for optimizing the presentation and enjoyment of wine. The present invention fulfills these needs and provides further related advantages.

SUMMARY OF THE INVENTION

In accordance with the invention, a wine glass constructed from molded and preferably transparent plastic comprises an upper body defining an upwardly narrowed flume for concentrating the wine bouquet, in combination with a contoured lower base defining an annular moat surrounding a central punt for enhanced visual inspection of the wine. In addition, the upper body of the wine glass further includes a notched indent at an outboard side thereof defining a generally horizontal and upwardly presented shelf for facilitated fingertip grasping and manipulation of the assembled glass, to correspondingly facilitate close inspection of bouquet and visual characteristics of wine contained therein.

In one preferred form of the invention, the upper body and lower base of the wine glass comprise separately formed modular components formed as by injection molding or the like. The modular upper body is adapted for quick and easy, substantially leak-proof assembly with the modular lower base to form an assembled wine glass having the upwardly narrowed flume in combination with the lower annular moat surrounding a central punt. This central punt may have an upwardly convex, generally hemispherical shape for enhanced visual inspection wine contained within the annular moat. The modular upper body and lower base are adapted for quick and easy disassembly for respective compact stacking of the separated modular components.

In an alternative preferred form of the invention, the upper body and lower base of the wine glass are formed with a unitary or one-piece construction as by blow molding or the like to define the upwardly narrowed flume in combination with the lower annular moat surrounding a central punt, and further defining the external notched indent. The central punt may circumscribe an upwardly concave central inner cup of predetermined or metered volumetric capacity for pour-in reception of a measured quantity of wine. The one-piece glass is adapted for compact stacking in a filled or unfilled state by reception of the upwardly narrowed flume at least partially into an annular cavity formed at the underside of the lower base of an overlying glass in the stack, at an inboard or radially inward position relative to the adjoining annular moat.

In one form, the wine glass of the present invention provides a convenient and compact commercial unit which may be marketed containing a serving of a selected wine or other beverage within a plastic or foil-based pouch or bag. The pouch or bag is initially contained within the wine glass in a position with a label on the pouch or bag visible through the transparent glass for easy external viewing. A seal member such as a removable cap is provided for normally closing the top of the wine glass with the pouch or bag therein to maintain product sanitation. Alternative seal members such as a shrink-wrap package may be used. In use, the seal member is removed for access to and removal of the pouch or bag, which is then opened and the contents thereof dispensed into the wine glass. After use, the entire commercial unit may be economically disposed.

In a further alternative embodiment of the invention, the beverage-containing pouch or bag includes a pour spout adapted for facilitated opening and controlled pour into a beverage glass, substantially without risk of beverage spillage. In such form, the pouch includes an open-ended slot formed near one corner of the pouch to define a tear-off strip in the form of a pull tab. The base or closed end of the tab-forming slot is coupled to a seal bar which sealing interconnects the front and back layers defining the pouch, and extends preferably in parallel closely spaced relation with an adjacent marginal edge of the pouch. The pour spout is defined between the seal bar and adjacent marginal edge of the pouch. In a preferred arrangement, the seal bar has a length of about 1 inch, and is spaced from about ⅛ to about ⅜ inch from the adjacent pouch marginal edge.

When opening of the pouch is desired, the pull tab is grasped and pulled in a direction toward the seal bar and the adjacent pouch marginal edge, thereby tearing the pouch-forming material in a line extending generally from the associated end of the seal bar to the pouch marginal edge to open the pour spout. During this pull tab manipulation, the spout can be retained by a person's finger or fingers in a pressed, substantially closed condition to preclude beverage leakage. In a most preferred form of the invention, the pouch-forming material is designed to resist tearing in a first direction while facilitating tearing in a second orthogonal direction. Such directionally oriented or "grained" pouch-forming material is oriented with the second direction extending generally in the direction of pull tab displacement to open the pour spout. Alternately stated, the pouch-forming material is oriented with the second direction extending generally perpendicular to the seal bar.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
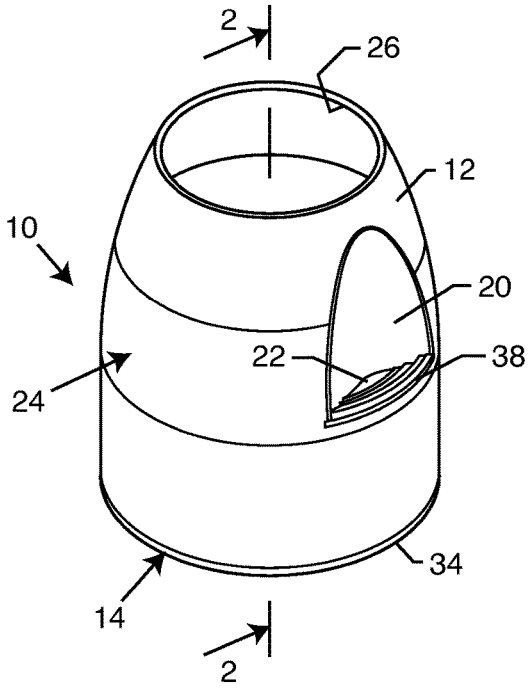
FIG. 1 is a perspective view illustrating a module wine glass constructed in accordance with one preferred form of the present invention.
Figure 5:
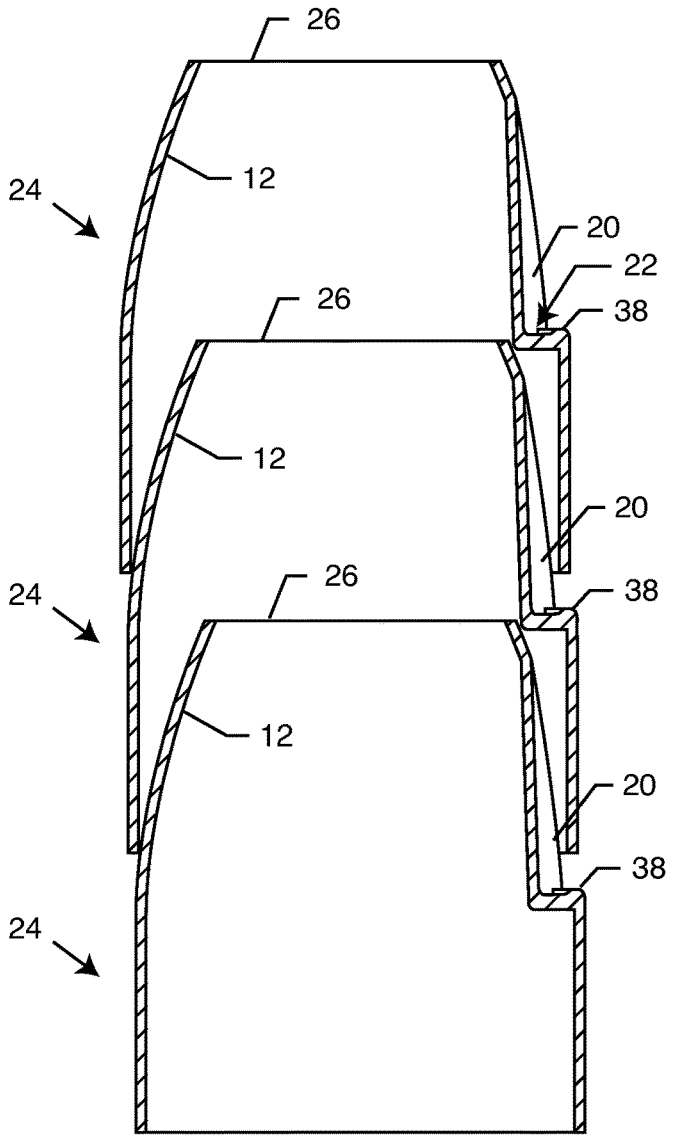
FIG. 5 is an enlarged vertical sectional view illustrating multiple upper body components for a plurality of wine glasses arranged in compact stacked relation.
Figure 6:
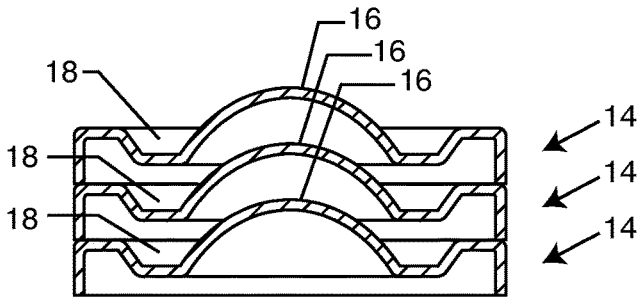
FIG. 6 is an enlarged vertical sectional view illustrating multiple lower base components for a plurality of wine glasses arranged in compact stacked relation.

As shown in the exemplary drawings, a wine glass referred to generally in FIG. 1 by the reference numeral 10 is constructed from molded plastic. In one preferred form (FIGS. 1-6), the wine glass has a modular construction defined by separately formed modular components adapted for quick and easy assembly to provide a leak-proof drinking vessel (FIGS. 1-4) particularly suited for drinking and/or sampling wine, and wherein these plastic modular components are further adapted in an unassembled state for compact nested stacking (FIGS. 5-6). In an alternative preferred form (FIGS. 7-10), a modified wine glass 110 has a unitary or one-piece construction adapted for relatively compact and partially nested stacking in a filled or unfilled state. Either embodiment may be integrated into a convenient commercial unit 200 (FIGS. 11-12) wherein a transparent wine glass 210 is provided in combination with a serving of wine or other beverage contained within a flexible pouch or bag 260.

The wine glass of the present invention is formed with a geometric shape designed for enhanced enjoyment of substantially the full range of characteristics attributable to a specific wine. More particularly, the wine glass incorporates an upper flume 12 of upwardly narrowing cross sectional shape for concentrating the wine aroma or bouquet. In addition, a lower region or bottom of the wine glass includes a contoured lower base 14 defining a central upstanding punt 16 surrounded by a recessed annular moat 18, wherein the punt 16 and moat 18 accommodate enhanced visual inspection of a small quantity of the wine contained and/or swirled within the moat 18. Further, the wine glass incorporates an external notched indent 20 defining a relatively shallow, upwardly presented and substantially horizontal exterior shelf 22 sized for convenient fingertip engagement, thereby facilitating fingertip grasping and manipulation of the wine glass. All of these features are provided in a relatively simple and cost-efficient construction suitable for formation by plastic molding processes.

As viewed in FIGS. 1-4, the illustrative modular wine glass 10 includes an upper shell-shaped body 24 in combination with the lower base 14, wherein these two components or modules are each adapted for construction by plastic molding or the like and subsequent assembly in substantially leak-proof relation. While a variety of different plastic materials may be used, one preferred plastic material comprises a substantially transparent polystyrene or the like having a density, strength and clarity conducive to close visual inspection of a beverage such as wine contained in the assembled glass, and suitable for relative economic production of the modular components as by injection molding or the like.

The upper body 24 has a generally circular cross sectional shape extending upwardly from a lower end, with at least some radially inward taper to accommodate formation by injection molding processes, with quick and easy release of the molded body 24 from an appropriately shaped mold cavity or die (not shown). In accordance with one key aspect of the invention, an upper region of this generally cylindrical tapered upper body defines the flume 12 having a more sharply or more significantly radially inwardly tapered cross sectional shape, corresponding closely with the inwardly tapered upper flume zone of a conventional wine glass constructed from a fragile glass material, terminating in an upper rim defining an open upper mouth 26 of reduced cross sectional size. This flume 12 of upwardly narrowing cross sectional area beneficially concentrates the aroma or bouquet of wine contained within the assembled modular glass 10.

At least one annular seal rib 28 (shown best in FIG. 4) is formed within the interior of the upper body 24 at a location spaced closely from a lower end thereof. This seal rib 28 is sized and shaped for interference, preferably snap-fit reception into a generally matingly shaped seal groove 30 (FIGS. 3-4) formed on the outboard side of a generally cylindrical outer wall 32 on the lower base component 14. A radially outwardly protruding lip 34 may be formed at a lower margin of the outer wall 32, for overlying and bearing against a lower margin of the upper body 24, when the two components are snap-fit assembled together. The seal rib 28 and associated seal groove 30 are sized and shaped to provide a substantially sealed or leak-proof interconnection or joint that may thus be disposed below the level of liquid contained within the assembled glass.

Alternately, persons skilled in the art will recognize and appreciate that the positions of the seal rib 28 and seal groove 30 may be reversed, i.e., that the seal rib 28 may be formed on the outer wall 32 of the lower base 14 for interference, substantially snap-fit reception into the associated seal groove 30 formed within the upper body 24 near the lower end thereof. Moreover, if desired, one or both of the seal rib 28 and the seal groove 30 may be coated with a thin film seal agent, such as a thin coating of a curable silicon-based gel or similar resilient seal material.

An upper margin of the outer wall 32 of the lower base 14 is molded integrally with a radially inwardly extending base plate defined by an outer annular segment 36 which cooperates with the axially centered and preferably upwardly convex, half-round or hemispherical punt 16 to form the upwardly open recessed annular moat 18 therebetween. As shown, the vertical dimension of the punt 16 preferably extends at least a short distance above the plane of the outer segment 36. The resultant volume of the moat 18, defined by the volume disposed below the plane of the outer segment 36, preferably comprises a predetermined volume for containing a predetermined quantity of a beverage such as wine, such as a volume on the order of about one fluid ounce or other selected volume suitable for sampling and assessing the characteristics of a particular wine. The shape of the punt 16, constructed from molded and preferably transparent plastic material, beneficially functions as a refracting or reflecting lens to enhance the light passing through wine contained within the moat 18, for correspondingly enhanced visual inspection of the wine color, clarity and meniscus.

In accordance with one important aspect of the invention, the outer annular segment 36 effectively cooperates with the shape of the recessed moat 18 and the central punt 16 to form a radially stiff construction for the lower base component 14. Accordingly, radially inward pressure applied to the lower base 14, by pressing inwardly on the upper body 24 in the region of the seal lip 28, does not result in radially inward deformation of the lower base 14. Such radially inwardly deformation of the lower base 14 would undesirably deflect the interfitting seal rib 28 and seal groove 30, with resulting potential for undesirable leakage of liquid past the seal structure. The stiff geometry of the lower base 14 functions to prevent such leakage from occurring.

In the unassembled state as viewed in FIG. 5, a plurality of plastic molded upper body components 24 can be assembled in a compact nested or stacked array for convenient, space-efficient shipment and/or storage. In a similar manner, in the unassembled state as viewed in FIG. 6, a plurality of plastic molded lower base components 14 can be stacked in a compact nested array for similarly compact shipment and/or storage. These components 24 and 26 can be snap-fit assembled when desired, quickly and easily, to form the assembled modular wine glass 10. After use, the plastic glass 10 can be discarded, or, if desired, disassembled for appropriate cleaning and compact storage preparatory to re-use.

In accordance with a further aspect of the invention, the upper body component 24 incorporates the indented notch 20 at the outboard side thereof, preferably at a position near or slightly below a vertical midpoint of the assembled modular glass 10, and at a location spaced substantially below the glass upper rim defining the open mouth 26. This indented notch 20 is defined in part at a lower end thereof by the substantially horizontal shelf 22 having a relatively narrow but sufficient horizontal depth to accommodate convenient fingertip grasping as by the tip of a person's thumb. An outboard margin of this shelf 22 may include a short upstanding and generally horizontally elongated rib 38 for further enhanced fingertip grasping and control. Accordingly, the assembled modular wine glass 10 can be readily grasped and manipulated with the fingertips, such as with the thumb and forefinger, in the course of inspecting and drinking wine contained therein.

In this regard, the shelf 22 with rib 38 is readily grasped by the thumb, while lifting the assembled glass 10 with the forefinger and/or middle finger engaging the lower base 14 and/or engaging a lower peripheral margin or edge generally at the lip 34, for easy and convenient lifting of the assembled glass 10 substantially to eye and nose level for optimal inspection of wine contained within the glass. The fingertip-grasped modular glass 10 can be held and manipulated easily by means of the notched shelf 22 and associated rib 38 for holding the glass 10 near the person's nose in the course of enjoying and/or grading the bouquet of the wine contained within the glass. In addition, the notched shelf 22 facilitates further manipulation of the glass for swirling close to the holder's eyes for visually inspecting a small quantity of wine contained within the lower end thereof, within or substantially filling the annular moat 18, particularly due to enhanced lighting effect attributable to the punt 16. Importantly, such manipulation and lifting of the wine glass 10 may occur substantially in the absence of grasping or smudging any extended surface area of the upper body 24 or the lower base 14. Moreover, such fingertip handling of the glass 10 minimizes surface area contact between the person's body and the glass, thereby also minimizing undesirable heat transfer from the person to the wine or the like contained within the glass. The shelf 22 further accommodates handling of the modular glass 10 in the course of drinking the wine.

Figure 2:
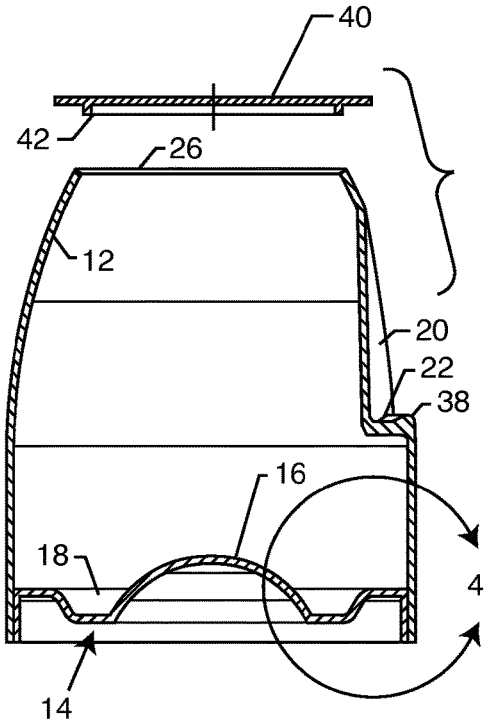
FIG. 2 is an enlarged vertical sectional view of the module wine glass taken generally on the line 2-2 of FIG. 1, and further illustrating a removable lid in exploded relation thereto.
Figure 3:
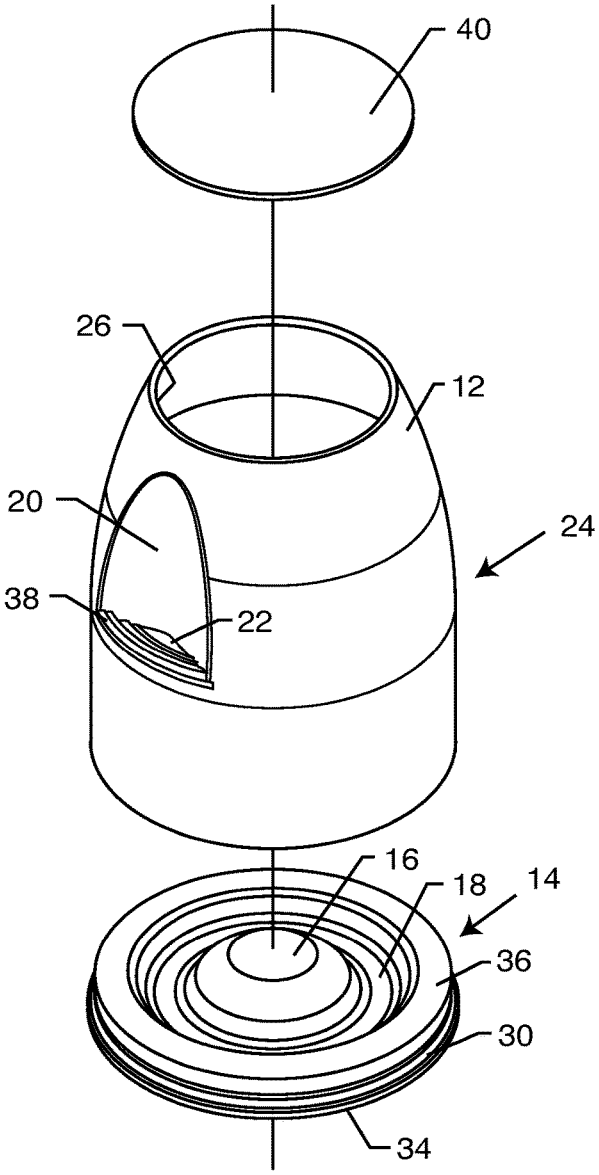
FIG. 3 is an exploded perspective view showing assembly of the components forming the modular wine glass.
Figure 4:
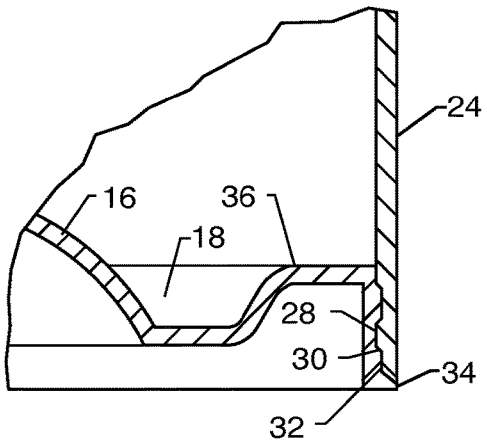
FIG. 4 is an enlarged and fragmented sectional corresponding generally with the encircled region 4 of FIG. 2.

If desired, a removable lid 40 may also be provided as a third component formed from molded plastic as by injection molding or the like, and adapted for removable mounting as by snap-fit connection onto the upper body component 24 to close the mouth 26 of the assembled glass 10. This lid component 40 is shown in FIGS. 2-3 in the form of a generally circular disk having a size and shape to overlie the open mouth 26, and further includes a depending annular lip 42 sized for snap-fit reception into the upper rim defining the open mouth 26. With this construction, the lid component 40 can be assembled and disassembled with the glass, as desired. The lid 40 (or the upper body 24) may also carry a label (not shown) or include a writable frosted region (also not shown) for identifying the vintage contained within the glass. Moreover, in the unassembled state, a plurality of lid components 40 can also be stacked in a compact array (not shown) for convenient shipping and storage.

FIGS. 7-10 illustrate an alternative preferred form of the invention wherein a modified wine glass 110 has a unitary or one-piece construction but otherwise incorporates structural and functional features identified by reference numerals common to the embodiment shown and described in FIGS. 1-6.

Figure 7:
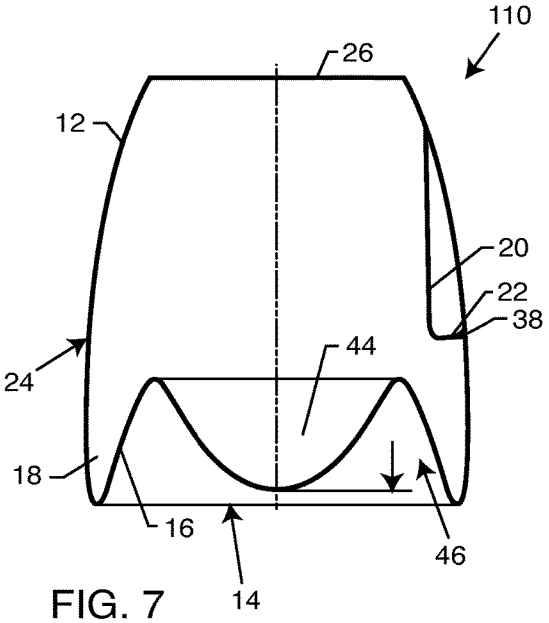
FIG. 7 is a vertical sectional view similar to FIG. 2, but depicting an alternative preferred form of the present invention.
Figure 9:
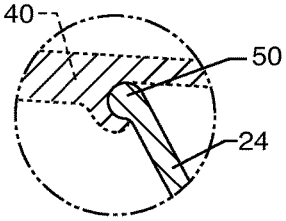
FIG. 9 is an enlarged fragmented sectional view corresponding generally with the encircled region 9 in FIG. 8.

More particularly, as viewed in FIG. 7 in vertical section, the modified wine glass 110 comprises an upper body 24 having a generally cylindrical cross sectional shape generally conforming with the embodiment of FIGS. 1-6, to include the upwardly narrowing upper flume 12 terminating at an upper edge or margin in the open mouth 26. A lower edge or margin of the upper body 24 is joined integrally with a one-piece construction to the lower base 14. The upper body 24 further includes the notched external indent 20 defining the shallow shelf 22 and associated raised rib 38. This notched indent 20 is again formed in the upper body 24 at a substantially mid-height position, i.e., spaced substantially below the mouth-defining upper rim of the glass. This one-piece wine glass 110 is also preferably constructed from a lightweight and relatively economical and preferably transparent plastic material such as a plastic material suitable for blow mold processes such as PET plastic and the like.

The lower base 14 of the one-piece wine glass 110 includes the annular moat 18 defined cooperatively at the lower periphery of the glass interior volume between a lower region of the upper body 24 and a central upstanding punt 16. In this embodiment, the punt 16 defines an upstanding annular wall formed to extend angularly upwardly and inwardly at a relatively steep angle from a lower margin of the upper body 24, whereby the moat-defining walls diverge upwardly from each other at an included angle on the order of about 10-20 degrees. This geometry provides extensive and improved viewing of the visual characteristics of wine contained within the moat 18.

In addition, the inboard moat-forming wall defined by the punt 16 is joined at an upper marginal edge thereof in circumscribing relation with an upwardly open, upwardly concave central inner bowl or cup 44 of predetermined or metered liquid volumetric capacity for pour-in reception of a measured quantity of wine. This central cup 44 is defined by a downwardly convex geometry that functions as a refracting or reflecting lens to enhance the light passing through wine contained within the cup 44, for correspondingly enhanced visual inspection of the wine color, clarity and meniscus. Alternately, persons skilled in the art will understand that the upstanding punt 16 shown in FIGS. 7-8 may have an upwardly convex shape as shown in FIGS. 1-6, or that the punt 16 shown in FIGS. 1-6 may incorporate the central cup 44.

Figure 8:
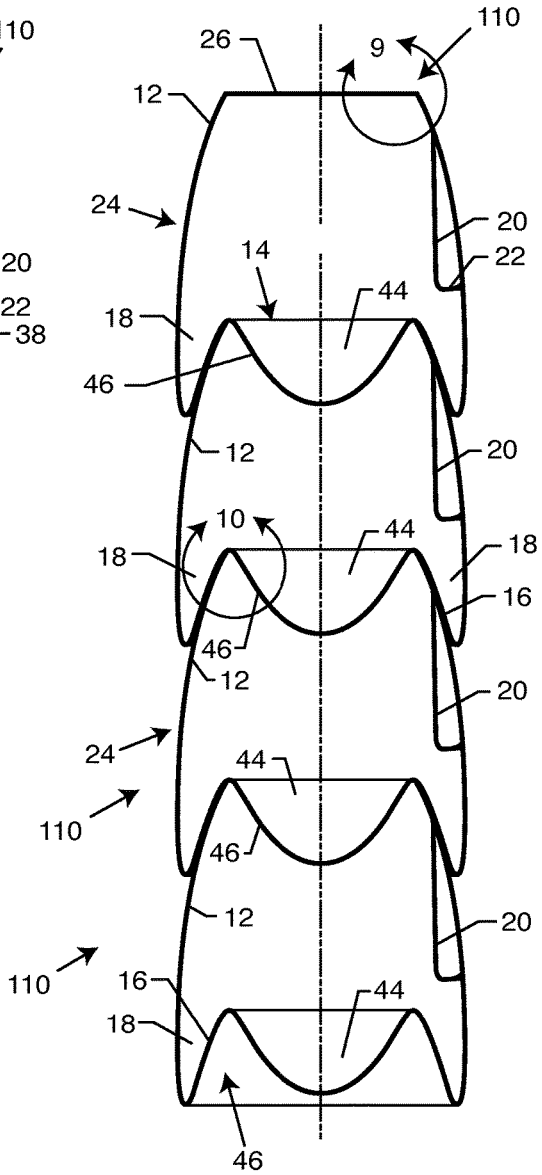
FIG. 8 is a vertical sectional view similar to FIG. 5, but showing a plurality of wine glasses constructed in accordance with the embodiment of FIG. 7 in compact stacked relation.
Figure 10:
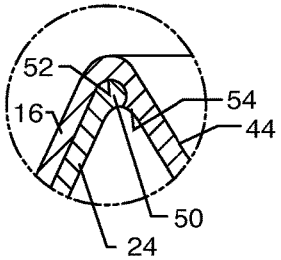
FIG. 10 is an enlarged fragmented sectional view corresponding generally with the encircled region 10 in FIG. 8.

In use, the modified wine glass 110 shown in FIGS. 7-8 is adapted for pour-in reception of a metered quantity of wine into the upwardly open central bowl or cup 44. The wine glass 110 can be grasped and manipulated as described previously with respect to FIGS. 1-6, for visually inspecting the wine within the cup 44. In addition, the wine glass can be manipulated to tip and thereby transfer the wine from the cup 44 into the surrounding moat 18 for further visual and olfactory inspection as previously described. Such manipulation of the wine glass 110 is accomplished easily by grasping the glass with minimal surface area contact between the person's fingertips and the glass, e.g., with the thumb and forefinger (and/or middle finger) respectively at the indented notch 20 and a lower marginal edge defined by the juncture of the upper body 24 and the upwardly extending wall forming the punt 16, substantially without obstructing viewing of the wine, without distorting wine viewing with fingerprints or other smudges, and with minimal undesirable heat transfer from the person's fingertips to the wine or the like contained within the glass.

More particularly, the central cup 44 is designed to receive a liquid beverage such as wine for the purpose of improved viewing, measuring and tasting of the beverage. In a preferred form, the central cup 44 defines a relatively broad upwardly presented and upwardly open surface area aligned generally with the open upper mouth of the glass, so that the beverage can be poured from above directly into the central cup 44, substantially without any significant portion of the beverage splashing or otherwise into or otherwise filling the surrounding moat 18. In this regard, the circumferential opening defined by the cup 44 is generally coaxially aligned with the mouth 26 and has a circumferential size of at least about ½ and preferably substantially equal to the circumferential size of the mouth 26. In the preferred geometry, the tapered flume geometry of the upper body 24 at least partially and preferably completely overlies the surrounding moat 18 so that direct-pour of the beverage through the mouth 26 and into the moat 18 is substantially precluded. That is, the moat 18 is, in the preferred form, positioned substantially in an undercut position relative to the rim of the glass defining the mouth 26, with the uppermost margin of the punt 16 aligned generally vertically with the glass rim.

In addition, the central cup 44 defines a liquid volume or capacity for receiving a sufficient yet limited and preferably metered quantity of the beverage for appropriate visual and olfactory inspection and judging, etc. A preferred capacity for the central cup 44 is within the range of from about ½ ounce to about 2 ounces, and most preferably about 1 ounce.

The central cup 44 accommodates manipulation of the glass 110 to swirl the beverage therein during this inspection process. The glass can be tipped from a vertical orientation to an angle on the order of about 45 so that the beverage can be swirled and spilled slowly over the uppermost margin of the punt 16 in a controlled or regulated flow into the surrounding moat 18. This process beneficially facilitates and enhances examination and judging characteristics such as color and viscosity of a beverage such as wine, and thereby increases enjoyment of the beverage. The glass 110 is especially suited for beverage examination and analysis, e.g., at a wine tasting event.

The one-piece wine glass 110 is also adapted for relatively compact stacking as viewed in FIG. 8. That is, the underside of the lower base 14 of each glass 110 defines an annular cavity 46 between the upstanding wall of the punt 16 and the downwardly convex central bowl or cup 44, wherein this cavity 46 has a size and shape for substantially nested partial reception of the upwardly narrowing flume 12 on the upper body 24 of an underlying glass 110 in the stack. In particular, the upwardly narrowing taper of the flume 12 is sized and shaped to substantially match the upwardly and inwardly tapered geometry of the punt wall, whereby these components are shaped and sized and essentially aligned vertically for relatively snug and substantially stable slide-fit interconnection when stacked. With this geometry, multiple glasses 110 can be stacked in a secure and stable manner in a partially filled condition, i.e., containing wine within the central cup 44 of each stacked glass 110 for convenient and rapid distribution to individuals, or alternately stacked in a secure and stable manner in an unfilled condition for relatively compact shipment and/or storage prior to or between uses.

Stacking of the multiple glasses 110 in a secure and stable manner is enhanced by forming the upper rim of each glass at the open mouth 26 to incorporate a rounded and slightly enlarged or thick-walled bead 50 (FIGS. 9 and 10) for snap-fit engagement with a matingly shaped detent channel 52 (FIG. 10) formed at the underside of each glass 110 generally at the transition between the upwardly extending inner wall or punt 16 of the moat 18 and the downwardly extending wall defining the central bowl or cup 44. In the preferred form, this detent channel 52 may be defined by a plurality, typically three or more, of circumferentially spaced shallow detent protrusions 54, although persons skilled in the art will recognize that an annular detent protrusion may be used if desired. The snap-fit interlocked stack of glasses 110 thus provides a stable array wherein the glasses 110 can be pre-filled each with a measured quantity of wine or the like, and with each underlying glass in the stack being substantially closed and sealed by the immediately overlying glass snap-fit attached thereto. In addition, the rounded bead 50 on the uppermost glass 110, or on each glass in an unstacked array, may be used for snap-fit mounting of a cap 40 (shown in dotted lines in FIG. 9) of the type shown and described in FIGS. 2-3. The pre-filled stacked glasses 110 can thus be prepared in advance for distribution yet maintained substantially sealed until actual distribution which may occur in a convenient and rapid manner.

In accordance with further aspects of the invention, the curved, downwardly convex shape of the inner bowl or cup 44 cooperates with the externally convex shape of the body 24 to magnify the liquid contents of the one-piece glass 110 under certain conditions. In particular, liquid such as wine contained within the cup 44 is magnified when viewed from the top of the glass 110, thereby permitting facilitated and closer inspection of the characteristics of the liquid. In addition, in the illustrative configuration as shown, a focal zone is believed to be created within a region extending generally from about ½ inch above the top of the central bowl or cup 44 to about ½ inch below the beaded upper rim 50 lining the mouth 26. Within this focal zone or region, and with the glass filled with liquid to approximately ½ inch below the beaded rim 50, a magnification effect due to light entering the transparent bottom and lower sides of the body 24 is believed to occur as light is refracted upwardly. The net effect of liquid within this focal zone magnifies liquid within the lower inner cup 44.

Figure 11:
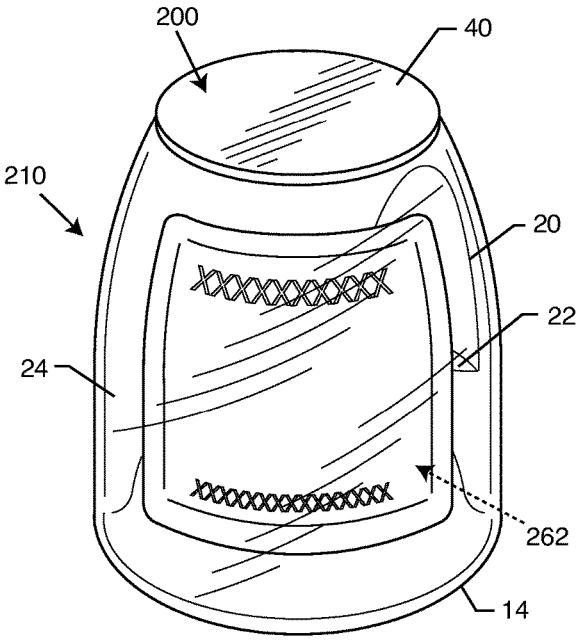
FIG. 11 is a front perspective view showing a wine glass constructed in accordance with the invention in combination with a pouch or bag containing a single serving of wine or the like contained therein.
Figure 12:
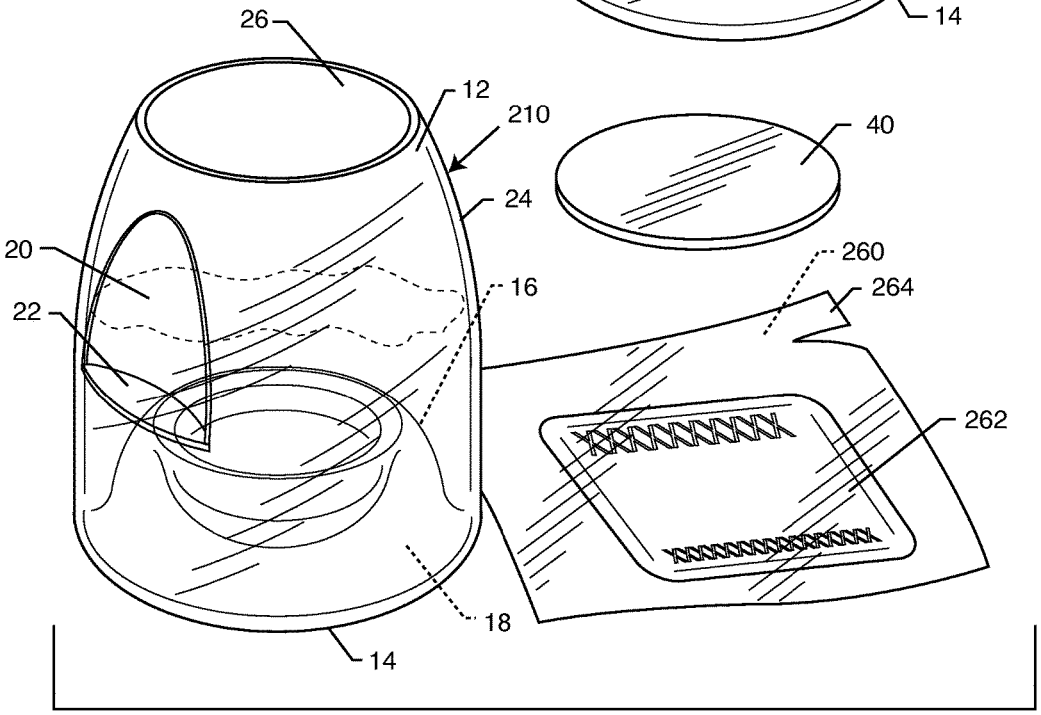
FIG. 12 is a front perspective view similar to FIG. 11, but showing the pouch or bag removed from the wine glass having the contents of the pouch or bag dispensed into the wine glass.
Figure 13:
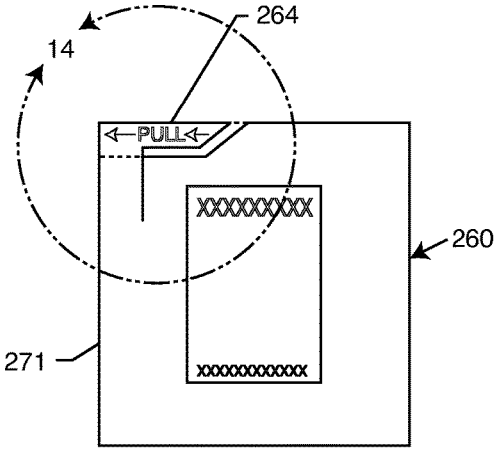
FIG. 13 is a plan view showing the pouch or bag removed from the wine glass, and incorporating one preferred tear-off strip for forming a controlled pour spout.

FIGS. 11-12 show a wine glass 210 which may be constructed in accordance with the foregoing described embodiments of the invention, wherein this wine glass 210 is provided as an integral portion of a commercial unit 200 which further includes a beverage such as a serving of wine contained initially within a sealed plastic or foil-based pouch or bag 260.

More particularly, the wine glass 210 (FIGS. 11-12) is shown generally in conformance with the embodiment depicted in FIGS. 7-10, including the notched indent 20 located substantially at a mid-height position on the glass body 24. Instead, the illustrative wine glass 210 has a one-piece construction comprising the upper body 24 of generally cylindrical sectional shape and tapering upwardly to define the narrowing upper flume 12 terminating at an upper edge or margin in the open mouth 26. A lower edge or margin of the upper body 24 is joined integrally with a one-piece construction to the lower base 14. The lower base 14 of the one-piece wine glass 210 includes the annular moat 18 defined cooperatively at the lower periphery of the glass interior volume between a lower region of the upper body 24 and a central upstanding punt 16. Similar to the embodiment of FIGS. 7-10, the central punt 16 defines an upwardly open, upwardly concave central inner bowl or cup of predetermined or metered liquid volumetric capacity for pour-in reception of a measured quantity of wine. In the preferred form, the one-piece wine glass 210 is again constructed from a lightweight, economical and transparent plastic material.

FIG. 11 shows the commercial unit 200 including the wine glass 210 in an initial configuration including the sealed pouch or bag 260 mounted therein. In this regard, the pouch or bag 260 comprises a flexible plastic or foiled-based structure containing a selected beverage, such as a selected wine, preferably in an amount representing a single serving. In the initial configuration, a label 262 on the pouch or bag 260 is readily visible through the transparent plastic upper body 24 of the wine glass to permit easy external viewing and reading of the contained beverage type, quantity, and source identification. A seal member 40 such as a lid or the like of the type shown and described in FIG. 2 normally closed and seals the pouch 260 within the glass 210 in a manner maintaining internal glass sanitation. Persons skilled in the art will appreciate that the seal member 40 may take alternative forms, such as a transparent plastic film shrink-wrap package or the like encasing the entire glass 210 with the beverage-containing pouch or bag 260 positioned therein.

In use, the seal member 40 is removed from the mouth 26 of the glass 210 for access to and removal of the pouch or bag 260 contained therein. The pouch 260 can then be opened in a normal manner, as by manually tearing an upper strip 264 as viewed in FIG. 12. With the pouch 260 opened, the pouch contents can be dispensed by pouring quickly and easily into the wine glass 210. After use, the entire commercial unit 200, including the glass 210, the pouch 260, and the seal member 40 can be economically discarded.

FIGS. 13-16 illustrate a preferred configuration for the beverage-containing pouch or bag 260 including a preferred tear-off strip 264 designed for creating a narrow open spout 266 (shown best in FIG. 16) for achieving a controlled beverage pour into the associated beverage glass 210, substantially without spillage.

More particularly, in the preferred form, the pouch or bag 260 is constructed from a substantially impervious barrier film or material, which is folded upon itself and suitably sealed and filled with the associated beverage such as wine. That is, the pouch or bag 260 is sealed at its perimeter to define an internal chamber (not shown) with the beverage contained therein. The barrier film is impervious to moisture ingress or egress, and is substantially impervious to ingress or egress of gas such as air. Preferred barrier films or materials comprise a plastic film material, with a most preferred material comprising a multi-ply material having at least one film layer which is uni-axially elongated or stretched for generally aligning long polymer molecules in a first direction to resist tearing in a second, orthogonally oriented direction while facilitating tearing in the first direction. One specific preferred multi-ply plastic film material comprises an outer film layer or ply formed from biaxially oriented polypropylene which may additionally include a metalization layer for blocking light (an important factor for many wines), an intermediate film layer or ply formed from biaxially oriented ethylene vinyl alcohol (EVOH), and an inner layer or ply formed from a polyethylene film having its long polymer molecules generally oriented to extend along said first direction. This multi-ply film material, in the embodiment of FIGS. 13-16, is oriented to facilitate tearing in a horizontal or left-right direction (i.e., in the direction of arrows 261 in FIG. 14).

The tear-off strip 264 comprises a pull tab 268 shown at one upper corner of the pouch or bag 260, wherein this pull tab 268 is physically separated from the remainder of the pouch 260 as by a cut forming a narrow slit or slot 270 of open-ended configuration. As shown best in FIG. 14, this slot 270 is formed near one upper corner of the pouch 260, and preferably extends angularly downwardly toward the adjacent pouch margin or side edge 271, and then turns laterally to extend toward said side edge 271 before terminating a short distance in spaced relation therewith. As shown, the slit or slot 270 terminates at a seal bar 273 which sealingly interconnects the front and back pouch-forming layers of the film material, and extends downwardly to extend a short distance (such as a distance of about 1 inch) generally in parallel with the adjacent side edge 271. In a preferred form, the slot 270 terminates and the seal bar 273 is spaced approximately from about ⅛ to about ⅜ inch from the adjacent side edge 271. If desired, the opposite or free end of the pull tab 268 may be joined across the slot 270 with the pouch by a narrow frangible control band 275, as shown in dotted lines in FIG. 14.

Figure 14:
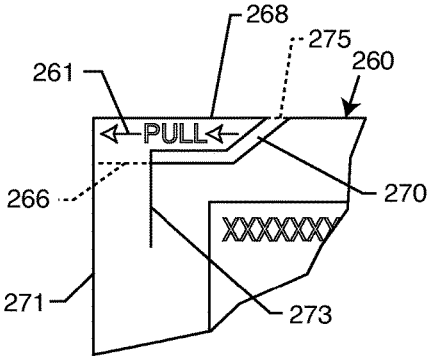
FIG. 14 is an enlarged fragmented plan view corresponding generally with the encircled region 14 in FIG. 13.
Figure 15:
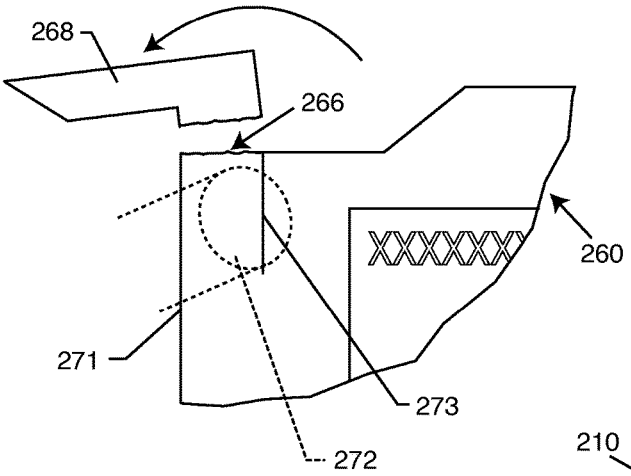
FIG. 15 is an enlarged fragmented plan view similar to FIG. 14, but illustration the tear-off strip separated from the remainder of the pouch or bag.
Figure 16:
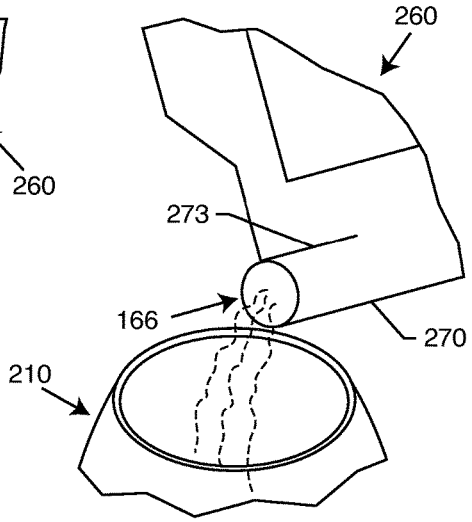
FIG. 16 is a fragmented perspective view showing controlled pour of the beverage from the pouch or bag into the beverage glass.

The seal bar 273 cooperates with the adjacent side margin or side edge 271 of the pouch 260 to define a narrow pour spout 266, when the pull tab 268 is separated from the remainder of the pouch. In this regard, the length of the seal bar 273 in combination with the cross sectional size of the spout 266 provides back-pressure which can be important in controlled pouring of liquid from the pouch or bag 260. When opening of the pouch or bag 260 is desired, the pouch is grasped by or between the person's thumb (or fingers) 272 (FIG. 15) in the region of the spout 266, i.e., in the region between the seal bar 273 and the adjacent marginal edge 271, while the pull tab 268 is grasped and physically pulled generally in a horizontal direction (as shown in FIGS. 14-15) as indicated by arrows 261. The word "PULL" and the arrows 261 may be printed onto or near the pull tab 268 to insure correct manipulation. Such pulling on the pull tab 268 draws the pull tab across the upper margin of the seal bar 273 to tear the pouch-forming film material between the seal bar 273 and the pouch side margin 271, thereby opening the spout 266 and exposing the spout throat. In a pouch or bag 260 with the oriented grain structure to facilitate tearing in a horizontal direction (as previously described) between the pull tab 268 and the adjacent marginal edge 271 of the pouch, the bag material will tear quickly and easily in a generally horizontal direction to form the open spout 266. The person's thumb (or other finger) 272 beneficially retains the spout 260 in a closed position to prevent liquid spillage during this opening procedure.

Thereafter, the separated pull tab 268 is discarded. The now-open pouch 260 can be partially inverted (as viewed in FIG. 16) for controlled pour of the liquid contents from the pouch 260 into the open mouth of the underlying glass 210.

Figure 17:
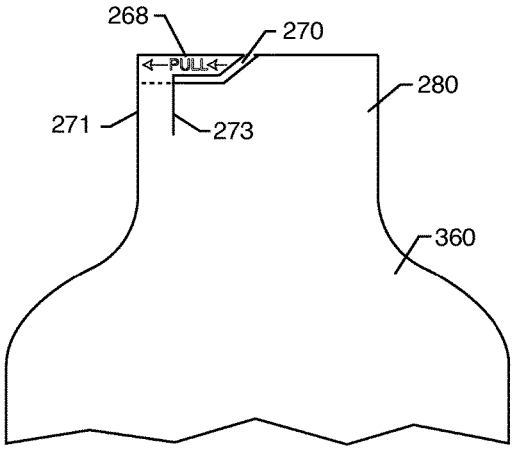
FIG. 17 is a fragmented plan view showing an alternative pouch configuration.
Figure 18:
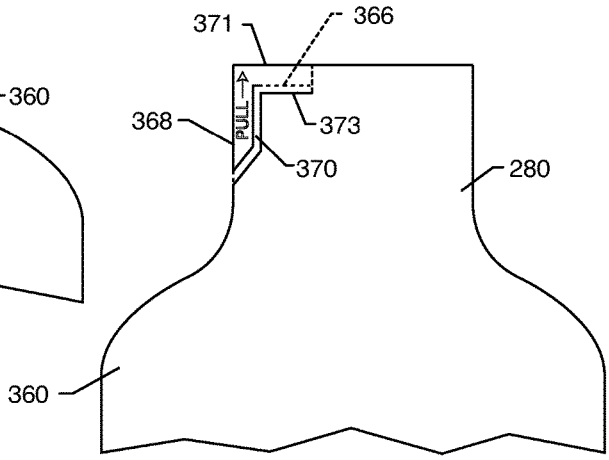
FIG. 18 is a fragmented plan view similar to FIG. 17, but illustrating an alternative tear-off strip configuration.

FIGS. 17 and 18 show a modified beverage-containing pouch or bag 360, wherein a pull tab structure is provided at one upper corner of a narrowed upper neck region 280 on an otherwise enlarged pouch configuration. FIG. 17 shows the pull tab 268 of the type shown and described with respect to FIGS. 13-16. FIG. 18 shows a modified pull tab 368 adapted for use, e.g., when the pouch material is oriented with a unidirectional grain structure to facilitate tearing generally in a vertical, as opposed to a horizontal, direction as shown. In FIG. 18, the modified pull tab 368 is designed for upward pulling action to tear open a pour spout 366. In FIG. 18, a slot 370 is formed between the pull tab 368 and the remainder of the pouch, wherein this slot terminates at an upper end with a seal bar 373 which extends a short distance generally in parallel with an upper marginal edge 371 of the pouch neck 280. A pour spout 366 is defined between the seal bar 373 and the upper marginal edge 371 of the pouch.

Figure 19:
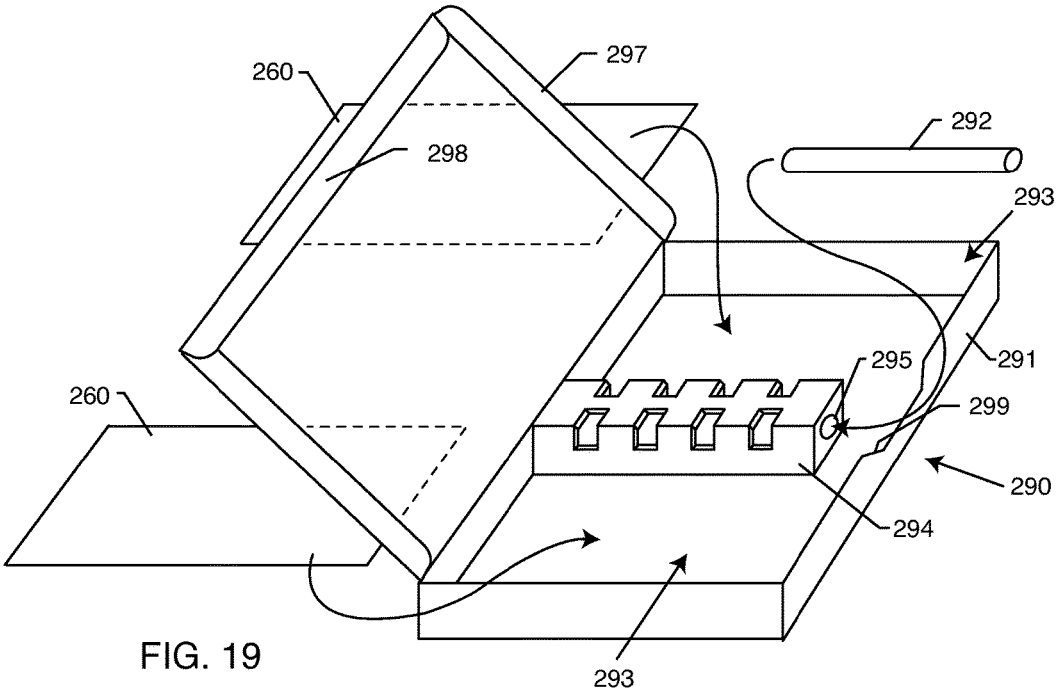
FIG. 19 is an exploded perspective view showing an exemplary pouch or bag in combination with a mailer and associated chiller means.

FIG. 19 shows a further embodiment of the invention, wherein one or more flexible pouches or bags, such as the illustrative and exemplary pouches 260, are adapted for placement into a mailer 290 along with an optional chiller device such as a $CO_2$ cartridge 292, or block of dry ice, or the like. The mailer 290 may comprise any convenient mailing or shipping receptacle, preferably insulated sufficiently to protect the contained pouch or pouches, and further to provide sufficient thermal insulation for suitable temperature maintenance over a typical shipment term of a few days. The illustrative mailer 290 (FIG. 19) comprises a base 291 defining an upwardly open cavity having a pair of upwardly open pockets 293 for nested reception of a pair of the pouches 260 on opposite sides of a central stabilizer 294. As shown, this stabilizer 294 has a forwardly open end 295 for slide-fit reception of the chiller cartridge 292, and vents 296 along the stabilizer length for thermal communication between the pouches 260 and the chiller cartridge 292. A gap 299 may be formed in a front wall of the mailer base 291 to facilitate insertion of the chiller cartridge 292. A mailer lid 297 folds over and suitably attaches to the base 291, with a lid flap 298 closing the gap 299, to enclose the pouches 260 for shipment. The mailer lid or flap 297 additionally functions, when closed, to effectively lock the chiller cartridge 292 within the central stabilizer 294 during shipment. Persons skilled in the art will appreciate that the mailer 290 may be also be adapted, if desired, for enclosing one or more wine glasses, such as the glass 110 or 210 previously described herein.

A variety of further modifications and improvements in and to the improved modular wine glass 10 and/or the unitary wine glass 110, and/or the commercial unit 200 of the present invention will be apparent to those persons skilled in the art. By way of example, the modified wine glass 110 may also incorporate a label or writable frosted zone (not shown) on the upper body 24. In addition, persons skilled in the art will appreciate that the wine glass 210 and/or the associated seal member 40 may take a wide variety of different geometric configurations. Accordingly, no limitation on the invention is intended by way of the foregoing description and accompanying drawings, except as set forth in the appended claims.

What is claimed is:

1. In combination:

a beverage glass including an upper generally shell-shaped body defining an upwardly narrowing tapered flume terminating at an upper margin thereof in an open mouth, and a lower base at a lower end of said upper body, said lower base defining a recessed annular moat, said upper body having an external notched indent formed therein generally at a mid-height position between said upper margin and said lower base, said notched indent defining an exterior shelf having a size and shape for convenient fingertip grasping;

a normally closed flexible pouch containing a beverage serving and received within said beverage glass; and a seal member extending across and closing said open mouth of said glass having said beverage-containing pouch received therein;

said seal member being removable from said open mouth to permit access to and removal of said beverage-containing pouch from said glass, and said pouch being adapted for opening to permit dispensing of said beverage serving from said pouch into said glass;

wherein said pouch has an open-ended slot formed therein defining said pull tab, and a seal bar extending from said slot in spaced relation with said adjacent marginal edge, said pour spout being defined between said seal bar and said adjacent marginal edge.

2. The combination of claim 1 wherein said flexible pouch has a tear-off strip thereon for manual opening thereof.

3. The combination of claim 2 wherein said pouch is tear-off strip comprises a pull tab cooperating with an adjacent marginal edge of said pouch to define a normally closed pour spout, said pull tab being separable from said pouch to open said pour spout.

4. The combination of claim 1 wherein said pouch includes an identification label, and further wherein said glass is at least partially transparent to permit external viewing of said label when said pouch is received within said glass.

5. The combination of claim 4 wherein said glass is constructed from a transparent molded plastic material.

6. The combination of claim 1 wherein said seal bar is spaced from about ⅛ inch to about ⅜ inch from said adjacent marginal edge of said pouch.

7. The combination of claim 1 wherein said pouch is formed from a barrier film material having at least one film ply constructed with a substantially unidirectionally oriented grain for resisting tearing in one direction and for facilitating tearing in a second direction, and further wherein said barrier film material is oriented with said second direction extending generally between said seal bar and said adjacent marginal edge of said pouch.

8. A beverage pouch, comprising:

a barrier film material defining a sealed perimeter and a hollow interior for receiving and supporting a selected beverage;

said pouch further including an open-ended slot defining a pull tab, said slot terminating in spaced relation with an adjacent marginal edge of said pouch and cooperating therewith to define a normally closed pour spout, said pull tab being separable from said pouch to open said pour spout;

wherein said slot terminates at a seal bar disposed in proximity with said adjacent marginal edge of said pouch and cooperating therewith to define said normally closed pour spout.

9. The beverage pouch of claim 8 wherein said seal bar is spaced from about ⅛ inch to about ⅜ inch from said adjacent marginal edge of said pouch.

10. The beverage pouch of claim 8 wherein said seal bar extends generally in parallel with said adjacent marginal edge.

11. The beverage pouch of claim 8 wherein said barrier film material has at least one film ply constructed with a substantially unidirectionally oriented grain for resisting tearing in one direction and for facilitating tearing in a second direction, and further wherein said barrier film material is oriented with said second direction extending generally between said open-ended slot and said adjacent marginal edge of said pouch.

12. The beverage pouch of claim 8 further comprising, in combination, a mailer adapted for receiving and supporting said pouch.

13. The beverage pouch of claim 12 further comprising, in combination, a chiller device receivable into said mailer.

14. The beverage pouch of claim 13 wherein said mailer defines at least one pocket for receiving and supporting at least one of said pouches, said at least one pocket being defined in part by a vented stabilizer for slide-fit reception and support of said chiller device.

15. The beverage pouch of claim 8 further comprising, in combination, a beverage glass having an open mouth and adapted for removably receiving said pouch, a seal member extending across and closing said open mouth of said glass having said pouch received therein, and said seal member being removable from said open mouth to permit access to and removal of said pouch from said glass, and said pouch being adapted for opening to permit dispensing of said beverage serving from said pouch through said pour spout into said glass.

16. The beverage pouch of claim 15 wherein said beverage glass is substantially transparent.

17. The beverage pouch of claim 15 wherein said beverage glass comprises a generally shell-shaped body extending upwardly from a lower base, said body having an external notched indent formed therein generally at a mid-height position between said mouth said lower base, said notched indent defining an exterior shelf having a size and shape for convenient fingertip grasping.

* * * * *